US007353981B2

(12) United States Patent
Groll

(10) Patent No.: US 7,353,981 B2
(45) Date of Patent: Apr. 8, 2008

(54) METHOD OF MAKING A COMPOSITE METAL SHEET

(75) Inventor: William A. Groll, McMurray, PA (US)

(73) Assignee: All-Clad Metalcrafters LLC, Cannonsburg, PA (US)

( * ) Notice: Subject to any disclaimer, the term of this patent is extended or adjusted under 35 U.S.C. 154(b) by 128 days.

(21) Appl. No.: 11/036,813

(22) Filed: Jan. 14, 2005

(65) Prior Publication Data

US 2005/0158576 A1 Jul. 21, 2005

Related U.S. Application Data

(60) Provisional application No. 60/536,940, filed on Jan. 15, 2004.

(51) Int. Cl.

| | |
|---|---|
| ***B23K 20/04*** | (2006.01) |
| ***B23K 20/227*** | (2006.01) |
| *A47J 36/02* | (2006.01) |
| *B32B 15/18* | (2006.01) |
| *B32B 15/20* | (2006.01) |

(52) U.S. Cl. ..... 228/190; 228/235.2; 428/653; 428/614; 428/685; 220/573.1

(58) Field of Classification Search ..... None
See application file for complete search history.

(56) References Cited

U.S. PATENT DOCUMENTS 3,017,492 A * 1/1962 Jepson ..... 219/439

(Continued)

FOREIGN PATENT DOCUMENTS

GB 2202480 * 9/1988

(Continued)

OTHER PUBLICATIONS

Translation of Japanese Kokai Patent Application No. Hei 4[1992]-313472.*

*Primary Examiner*—John J Zimmerman
(74) *Attorney, Agent, or Firm*—The Webb Law Firm, P.C.

(57) ABSTRACT

A composite metal sheet for use in making lightweight cookware or as a food warming tray comprising a layer of aluminum roll bonded to a layer of stainless steel defining a food-contacting surface on a first side. The food warming tray embodiment also includes a layer of stainless steel mesh roll bonded on a second side. A method of making a composite metal sheet for cookware comprising the steps of: providing a roll pack of ordered layers consisting of (a) a layer of Alclad aluminum, (b) a layer of stainless steel foil, (c) a reusable plate or platen of stainless steel, (d) a layer of stainless steel foil, and (e) a layer of Alclad aluminum; heating the roll pack to a rolling temperature of about 725°-775° F., preferably about 750° F.; and rolling the heated roll pack in a rolling mill at a reduction of 10-20% in one pass to provide two roll bonded composite sheets, the first composite sheet comprising layers (a)-(b) above, and the second composite sheet comprising layers (d)-(e) above with plate (c) being reusable, wherein the plate of stainless steel is stationary relative to the layers of stainless steel foil during rolling as the roll pack passes through the mill, and wherein the plate transfers a bonding pressure to the aluminum and foil layers without tearing or displacing the foil. The method for making the food warming tray includes the addition of a layer of stainless steel mesh applied to the outer surfaces of Alclad aluminum.

1 Claim, 2 Drawing Sheets

U.S. PATENT DOCUMENTS

| | | | | | |
|---|---|---|---|---|---|
| 3,650,144 | A | * | 3/1972 | James | 72/467 |
| 3,708,938 | A | * | 1/1973 | Tantlinger | 52/471 |
| 4,103,076 | A | | 7/1978 | Ulam | |
| 4,246,045 | A | | 1/1981 | Ulam | |
| 4,646,935 | A | | 3/1987 | Ulam | |
| 4,684,781 | A | * | 8/1987 | Frish et al. | 219/121.78 |
| 5,564,590 | A | * | 10/1996 | Kim | 220/626 |
| 5,647,271 | A | * | 7/1997 | Capelle et al. | 99/422 |
| 6,061,892 | A | * | 5/2000 | Kassi | 29/505 |
| 6,109,504 | A | | 8/2000 | Groll | |
| 6,235,409 | B1 | * | 5/2001 | Serafin et al. | 428/654 |
| 6,267,830 | B1 | | 7/2001 | Groll | |
| 6,427,904 | B1 | | 8/2002 | Groll | |
| 2003/0160053 | A1 | * | 8/2003 | Kim | 220/573.1 |
| 2005/0040171 | A1 | * | 2/2005 | Alim | 220/573.1 |

FOREIGN PATENT DOCUMENTS

| | | | |
|---|---|---|---|
| JP | 01-194942 | * | 8/1989 |
| JP | 02-085695 | * | 3/1990 |
| JP | 04-313472 | * | 11/1992 |
| JP | 04-327383 | * | 11/1992 |
| JP | 07-185839 | * | 7/1995 |
| WO | WO 96/06552 | * | 3/1996 |

* cited by examiner

METHOD OF MAKING A COMPOSITE METAL SHEET

CROSS-REFERENCE TO RELATED APPLICATION

This application claims the benefit of U.S. Provisional Application No. 60/536,940, filed Jan. 15, 2004, which is incorporated herein by reference.

BACKGROUND OF THE INVENTION

1. Field of the Invention

The present invention relates generally to lightweight cookware suitable for hiking and camping as well as for food warming trays used in commercial food warming cabinets. More particularly, this invention relates to composite metal cookware which has a very thin layer of stainless steel on the food contacting surfaces with a layer of aluminum bonded thereto. The invention also relates to a method of making the composite metal product used in constructing the lightweight cookware and warming trays.

2. Description of Related Art

Hikers and campers desire lightweight cookware for ease of travel, particularly when backpacking. Such cookware should ideally be strong in order to resist deformation when packed tightly in a backpack, but it should also exhibit high heat conductivity so as to make efficient use of the limited heating fuel carried by the hiker. Such cookware should also offer easy cleaning for the user. Solid aluminum cookware offers light weight in thin sections, but can be easily bent or deformed during hiking due to its relatively weak strength. Cleaning of bare aluminum cook surface is also problematic. A non-stick PTFE surface also lacks long-term durability on aluminum cookware and is prone to abrasive wear. On the other hand, solid stainless steel cookware is strong and offers better cleaning, but is heavy. In addition, stainless steel is very inefficient in thermal conductivity, which results in excessive fuel consumption during cooking, which is a major concern with portable cooking stoves used by hikers.

It is known to produce three-ply composite cookware of stainless steel layers on the cook surface and outer surface with a core layer of aluminum to provide better heat conductivity and strength. However, present techniques for roll bonding stainless steel and aluminum require relatively thick gauges of stainless steel which adversely affects the weight of the cookware, making it unattractive for use in hiking.

Commercial food warming trays, particularly those used in the fast food industry, are typically made from anodized aluminum. These trays each have an electrical resistance heating means affixed to the underside thereof, along with a temperature controlling thermostat, to maintain the food product on the upper surface at a constant desired temperature prior to service. Aluminum is a good material for the warming tray because of its relative light weight and high coefficient of thermal conductivity. In recent times, however, aluminum has fallen into disfavor for use as a food contacting surface in the commercial food preparation industry.

Accordingly, there is a need for replacing aluminum as a food contacting surface in commercial food warming trays. Stainless steel appears to be a potential replacement candidate for aluminum because of its excellent properties concerning chemical inertness toward food, scratch resistance and overall good appearance. Unfortunately, stainless steel has relatively poor thermal conductivity properties compared to aluminum while also being much heavier.

A bimetal composite of stainless steel and aluminum, in which the stainless steel forms the food contacting surface, also comes to mind but this would have the drawback of warping during use due to the differences in thermal expansion properties of the two materials when bonded in a bimetal construction.

A three-ply composite of stainless steel—aluminum—stainless steel also comes to mind for solving the thermal warpage problem, but this, too, is problematic because the stainless steel underside offers poor thermal responsiveness for the heater and thermostat.

SUMMARY OF THE INVENTION

My invention solves the problems encountered in the prior art by providing a novel composite metal sheet which is an ideal material for making lightweight, highly efficient cookware for hikers and, in a modified embodiment, for commercial food warming trays. The composite metal sheet of the present invention concerning cookware comprises a relatively thick aluminum layer with an upper food contacting surface of very thin gauge stainless steel (about 0.002 inch) roll bonded thereto. The outer aluminum surface of this cookware is preferably hard coat anodized for improved appearance and improved heat absorption due to its dark color.

In the food warming embodiment, a lower surface comprising a sheet of stainless steel mesh (screen) is roll bonded to the aluminum layer. Roll bonding the thin upper stainless steel foil layer to the aluminum layer is conducted at an elevated temperature, on the order of about 750° F. The roll bonding provides a metallurgical bond between the aluminum and the layer of stainless steel of the upper cook surface. In the food warming tray embodiment, a stainless steel mesh is positioned on a lower surface of the aluminum layer. During roll bonding, the aluminum plastically flows in the openings in the stainless steel mesh to bond therewith and to cause the aluminum metal to form a substantial portion of the lower surface. The presence of the aluminum material along the lower surface allows direct contact of the heating means and thermostat with the high thermal conductivity aluminum which, in turn, provides thermal responsiveness akin to an all-aluminum tray. The very thin stainless steel food contacting surface bonded to the much thicker aluminum core avoids thermal warpage problems and provides a more chemically inert and hard, scratch-resistant food-contacting surface.

The novel method of roll bonding very thin stainless steel foil to aluminum sheet for making cookware according to the present invention comprises the steps of:

(a) providing a roll pack of ordered layers comprising:

1. a first layer of Alclad aluminum sheet;
2. a first layer of stainless steel foil;
3. a plate of stainless steel;
4. a second layer of stainless steel foil; and
5. a second layer of Alclad aluminum sheet;

(b) heating the roll pack of step (a) to a rolling temperature; and (c) rolling the heated roll pack in a rolling mill to provide two roll bonded composite sheets, the first composite sheet comprising the first layers of Alclad aluminum and stainless steel foil, and the second composite sheet comprising the second layers of Alclad aluminum and stainless steel foil. The plate of stainless steel is reusable.

Alternatively, only one composite sheet could be made by forming a roll pack comprising layers (a) 1-3 or layers (a) 3-5 and rolling or otherwise compressing those roll packs separately.

The composite sheets are then deep drawn into desired cookware shapes using well-known techniques. The aluminum surface is preferably anodized to provide a hard scratch-resistant attractive outer surface which also readily absorbs heat due to high emissivity of its dark gray/black color. The stainless steel inner cook surface is preferably polished to a bright luster finish for appearance and improved non-stick properties. A further non-stick layer of PTFE or other non-stick surface can be applied to the stainless steel surface if desired.

The novel method of making the composite metal sheets for making the food warming tray described above comprises the steps of:

(a) providing a roll pack of ordered layers comprising:

1. a layer of stainless steel mesh;
2. a core layer or plate of Alclad aluminum;
3. a layer of stainless steel foil;
4. a plate of stainless steel;
5. a layer of stainless steel foil;
6. a core layer of Alclad aluminum; and
7. a layer of stainless steel mesh;

(b) heating the roll pack of step (a) to a rolling temperature; and (c) rolling the heated roll pack in a rolling mill to provide two roll bonded composite sheets, the first composite sheet comprising layers (a) 1-3 above, and the second composite sheet comprising layers (a) 5-7 above with plate (a) 4 being reusable.

The plate of stainless steel remains stationary relative to the layers of stainless steel foil during rolling as the roll pack passes through the rolls of the mill. The stainless steel plate transfers a bonding pressure to the stainless steel foil without tearing or displacing it, which would otherwise occur if direct contact with the rotating rolls would take place.

DETAILED DESCRIPTION OF THE INVENTION

Lightweight Cookware Embodiment

Figure 1:
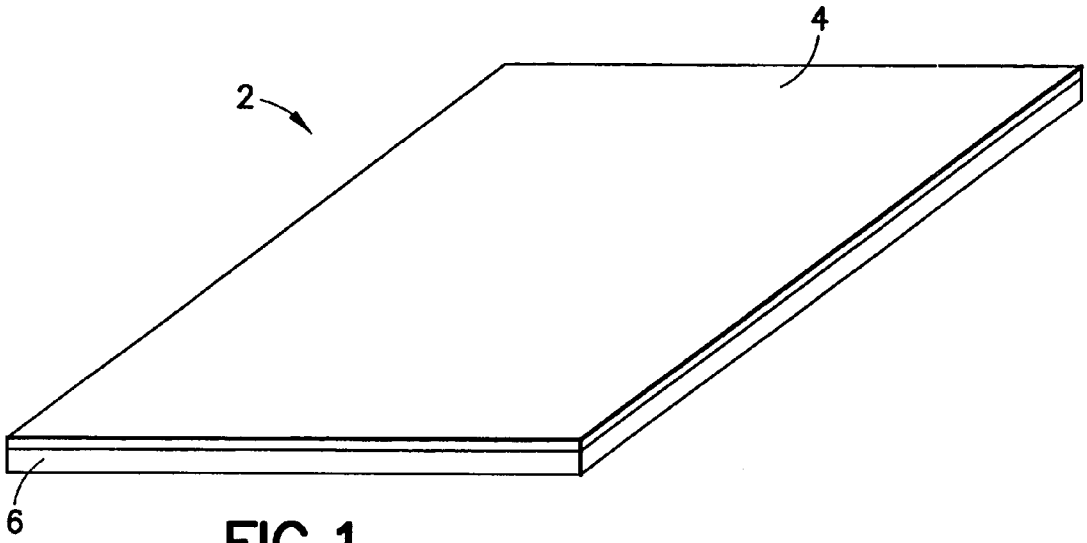
FIG. 1 is a perspective view of a composite metal sheet of the present invention suitable for making lightweight cookware.
Figure 2:
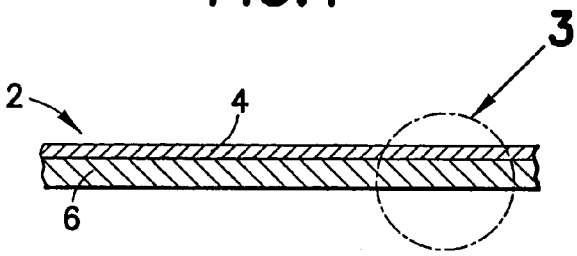
FIG. 2 is a cross-sectional end view of the composite metal sheet taken along section line II-II of FIG. 1.
Figure 3:
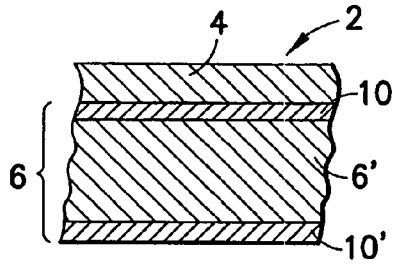
FIG. 3 is an enlarged, fragmentary view of a portion of the cross-section of FIG. 2.

A composite metal sheet 2 of the present invention shown in FIGS. 1-3 is suitable for making lightweight cookware. The composite metal sheet 2 comprises a layer 4 of very thin stainless steel which functions as the food contacting cook surface, and a thicker layer 6 of aluminum, roll bonded to the stainless steel layer 4. The aluminum layer 6 is preferably a sheet of Alclad aluminum which itself is a prebonded composite consisting of an aluminum alloy core layer 6' and outer layers 10 and 10' of substantially pure aluminum. A typical Alclad aluminum has a core layer 6' of an aluminum alloy for strength, such as type 3004, 3005 or 5005, while the substantially pure outer layers 10 and 10' may be Type 1100, 1130, 1230, 1145, 1175 or 7072. Type 3004 and Type 1145 aluminum are preferred. The pure aluminum layer 10 provides excellent roll bonding with the stainless steel layer 4. After the cooking utensil is formed, the aluminum layer 10' which forms the outside surface of the cooking utensil is preferably hard coat anodized to a black color to provide high emissivity to improve camp stove cooking efficiencies due to its high heat absorption properties. The hard anodized surface is also visually attractive and provides scratch resistance.

The composite metal sheet 2 after roll bonding is about 0.080 inch thick with the stainless steel layer 4 being about 0.002-0.004 inch in thickness and the aluminum layer 6 having a thickness of about 0.076-0.078 inch.

The stainless steel layer 4 of the composite metal sheet 2 is preferably an austenitic grade in the 300 series such as Type 304, also sometimes referred to as "18/10" stainless steel (18% Cr, 10% Ni). In order to achieve the light weight required, it is necessary to start with a very thin stainless steel material, such as a stainless steel foil 12 shown in FIG. 4, of about 0.002-0.004 inch in thickness. Using conventional roll bonding techniques, it is not possible to roll bond a stainless steel foil to a sheet of aluminum because the mill rolls will cause the foil to tear. My invention also includes a novel roll bonding method which makes it possible to roll bond stainless steel foil to aluminum sheet.

Figure 4:
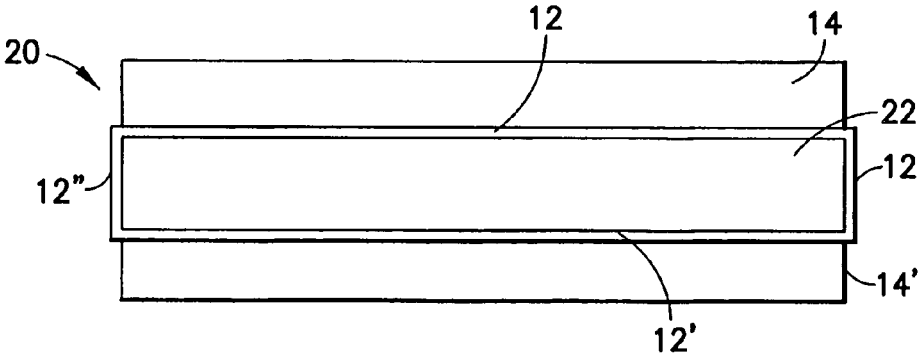
FIG. 4 is a side elevation view of a stacked roll pack of ordered layers for use in the manufacture of two composite metal sheets of the invention depicted in FIGS. 1-3.

In order to achieve this goal, a roll pack 20 of FIG. 4 is used. Roll pack 20 is used to roll bond the thin stainless steel foil and, in the configuration depicted in FIG. 4, produces two composite sheets 2 of the form shown in FIG. 1. The roll pack 20 utilizes a relatively thick plate 22 of stainless steel located in the center of the roll pack with a layer of stainless steel foil 12 having a thickness of about 0.003 inch positioned on the upper and lower horizontal surfaces of the plate 22. The stainless steel plate 22 is rectangularly shaped of any desired size that can be conveniently handled, for example, about 2 feet wide×3 feet long and about 0.125 inch thick. The stainless steel foil 12 is also preferably wrapped around the leading edge of the plate 22 as shown at portion 12" in order to stabilize the foil 12 as the roll pack 20 enters the rolls of the rolling mill. An upper sheet 14 of Alclad aluminum having a thickness of about 0.095 inch and a lower sheet 14' of Alclad aluminum of the same thickness face the stainless steel foil portions 12 and 12', respectively, so as to complete the construction of the roll pack 20. The so-configured roll pack 20 is then heated in a furnace to a rolling temperature of about 725°-775° F., preferably about 750° F. The heated roll pack 20 is then given one pass in a rolling mill at a desired reduction of between 10-20%. During rolling, the stainless steel plate 22 remains stationary relative to the foil layers 12, 12' while the Alclad aluminum layers 14 and 14' are respectively engaged by the rotating rolls of the rolling mill (not shown). The plate 22 does, however, move with the roll pack 20 through the rolling mill rolls but is not deformed thereby due to its thickness and relatively low rolling temperature.

The rolling pressure exerted by the rolls imparts a compressive force between the Alclad aluminum layers 14, 14', FOIL LAYERS 12, 12' and the plate 22 causing bonding between the stainless steel foil layers 12, 12' and the respective Alclad aluminum layers 14, 14'. The stainless steel plate 22 acts as a stationary pressure platen with respect to the stainless steel foil 12, 12' causing bonding between the foil 12, 12' and the respective aluminum layers 14 and 14'. No bonding occurs between the stainless steel plate 22 and the stainless steel foil 12, 12' because at the relatively low rolling temperature of 750° F., the stainless steel plate 22 will not bond with the foil. Rather, under these rolling conditions, the respective stainless steel foil layers 12, 12' will metallurgically bond with the pure aluminum layer 10 of the respective Alclad aluminum layers 14 and 14'. The fact that the plate 22 acts as a stationary platen relative to the foil layers 12, 12' results in the delivery of compressive rolling force to the foil in a normal (90°) direction, with no rolling forces being delivered to the foil in the rolling direction or lateral direction, which would otherwise cause tearing of the thin foil 12, 12'. In this manner, I have been able to roll bond very thin gauges of stainless steel foil to aluminum sheet which heretofore has not been possible using conventional rolling techniques.

The roll pack 20 depicted in FIG. 4 produces two composite metal sheets such as sheet 2 of FIG. 1 comprising (as seen in FIG. 4) a first composite sheet made up of Alclad layer 14 and a thin stainless steel layer formed from foil 12 and a second composite sheet made up of Alclad layer 14' and a thin stainless steel layer 12'. The stainless steel plate 22 may then be re-used in subsequent roll bonding operations since, as stated above, the foil 12, 12' does not bond thereto during rolling.

The roll bonded composite plate 2 of FIG. 1 is then blanked and deep drawn into desired shapes and sizes for cookware, such as fry pans, pots and the like. This forming operation is well known in the art and need not be explained in any detail. Preferably, drawing is conducted in a hydroforming press. After drawing, the outer surface of the cookware formed by the layer 6 of aluminum is preferably hard coat anodized to a dark color for enhanced appearance, scratch resistance and improved heating efficiency. The inner stainless steel layer 4 forms the cook surface of the cookware and may be polished to a high luster finish to provide a pleasing appearance as well as improved stick resistance and clean-up.

highly acidic food and non-stick coatings are subject to mechanical damage, allowing the chemical attack of the substrate. The stainless steel cook surface of the invention resists this chemical and corrosive attack.

The dark hard coat anodized aluminum exterior of the utensil is cosmetically attractive and is also a highly efficient absorber of heat. This is especially desirable to the hiker looking to maximize fuel for small backpacking stoves.

The radial dispersion of heat is promoted by the aluminum layer. The elimination of hot spots is also important for ease of cleaning.

Solid metals such as stainless steel and titanium have very poor conductivity. When these metals are exposed to a flame, the uneven expansion of hot spots causes warpage. The cookware of the invention fights warpage because its conductive aluminum layer prevents hot spots.

The component metals of the composite sheet (aluminum and stainless steel) of the invention offer practically no weight penalty for the presence of the very thin stainless steel layer. The stainless steel layer is less than the thickness of a typical sheet of paper, yet offers strength and wear resistance that will last a lifetime of use.

The highly polished stainless steel surface will not be damaged in elevated temperatures by use of metal utensils. This is not true of non-stick or solid aluminum vessels which are relatively soft and prone to scratching.

The crush resistance of the composite cookware vessels made according to the present invention is superior to aluminum alone, which is either coated or uncoated due to the presence of the strong stainless steel layer. Hence, the cookware vessel of the invention is dent- and bend-resistant, making it ideal for backpacking.

Stainless steel can be difficult to clean when subject to localized heat. The conductivity of the composite of the invention prevents localized heat by virtue of the aluminum layer and is therefore easy to clean.

The following table compares characteristics and conventional camping cookware products with those of the present invention.

TABLE

| | Stainless Steel | Uncoated Aluminum | Non-Stick Aluminum | Hard Anodized Aluminum | Titanium | Present Invention |
|---|---|---|---|---|---|---|
| Corrosion & Chemical Resistance | 5 | 1 | 4 | 2 | 5 | 5 |
| Heat Absorption | 1 | 5 | 5 | 5 | 1 | 5 |
| Heat Dispersion | 1 | 5 | 5 | 5 | 1 | 5 |
| Warpage | 1 | 5 | 4 | 4 | 1 | 5 |
| Weight | 2 | 5 | 5 | 5 | 5 | 5 |
| Wear Resistance | 5 | 1 | 1 | 1 | 5 | 5 |
| Crush Resistance | 5 | 1 | 1 | 1 | 5 | 5 |
| Ease of Cleaning | 3 | 1 | 5 | 5 | 3 | 5 |

5 EXCELLENT
4 GOOD
3 AVERAGE
2 POOR
1 VERY POOR

Benefits of the Invention

The interior layer of the present cookware is a high quality 18/10 (also referred to as Type 304) stainless steel, making it chemical- and corrosion-resistant. Cookware surfaces are known to be subject to attack by strong caustic cleaners or

Warming Tray Embodiment

Figure 5:
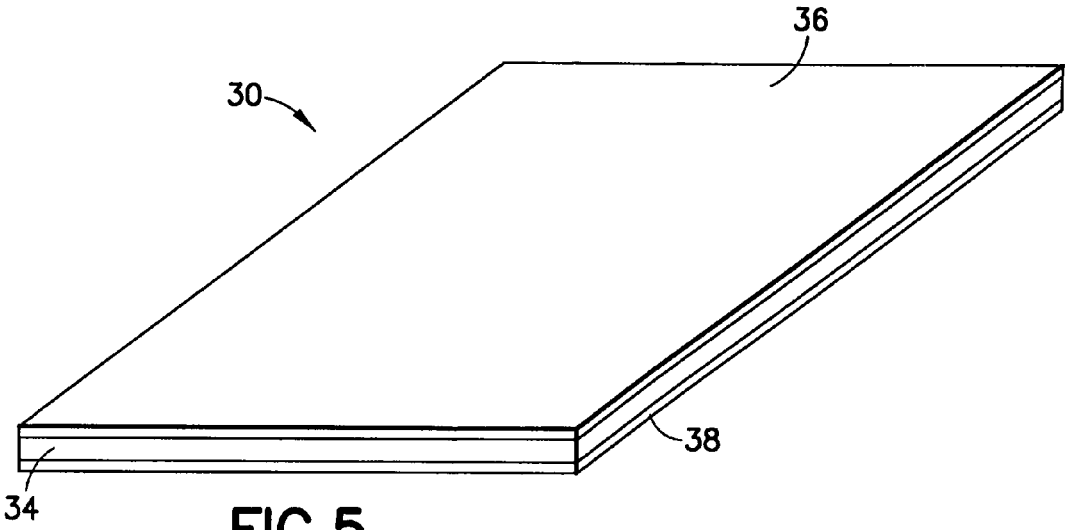
FIGS. 5-8 are views similar to FIGS. 1-4, respectively, but for making the food warning tray embodiment according to the present invention.
Figure 6:
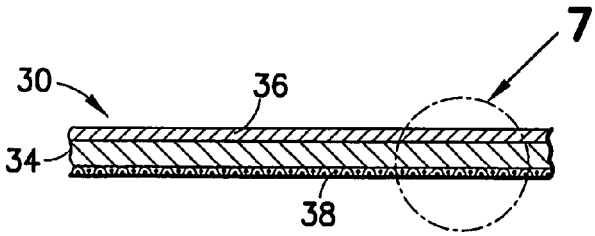

Referring now to FIGS. 5-8 of the drawings, a further embodiment of the composite metal sheet of the present invention is identified by reference number 30 throughout the drawing figures, where applicable. The composite metal sheet 30 is useful in functioning as a warming tray for applications such as in connection with commercial fast food operations. The composite metal sheet 30 functions as a commercial warming tray substantially in the configuration as shown in FIG. 5 except for the addition of appropriate handles, if any, and electrical components, such as a thermostat and electrical resistance heating element which would be affixed to the warming tray in their usual and customary positions (not shown).

Figure 7:
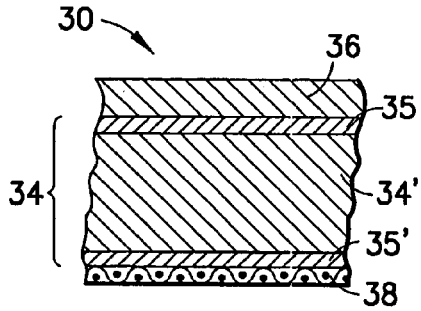

The composite metal sheet 30 comprises a core 34 of a metal of high thermal conductivity which is preferably aluminum. Aluminum possesses high thermal conductivity while being relatively light in weight. The food contacting surface of the composite 30 forming the warming tray is constructed of a thin layer of stainless steel foil 36. The lower surface of the composite 30 is formed from a stainless steel mesh or screen material 38. The aluminum core 34, as perhaps best seen in FIG. 7, is preferably made from an Alclad commercial product which consists of a core region 34' made from an aluminum alloy such as alloy 3003 and carries previously roll bonded outer layers 35, 35' of substantially pure aluminum as described above. As will be explained in greater detail hereinafter, the composite metal sheet 30 of the invention is formed by roll bonding so that the stainless steel food contacting surface 36 is metallurgically bonded to the aluminum layer 34 via the pure aluminum layer 35 while the lower stainless steel mesh material 38 is also bonded to the underside of the aluminum layer 34 via the pure aluminum layer 35'. As best seen in FIG. 7, after roll bonding, the aluminum material 35' protrudes between the strands of wire that form the stainless steel mesh 38. In this manner, the electrical heating means (not shown) employed in the warming tray is able to directly contact the high thermal conductivity aluminum layer 34 so as to transfer heat more rapidly to the food contacting surface 36. Likewise, due to the very thin gauge of the stainless steel foil forming the food contacting surface 36, heat rapidly passes therethrough to warm the food product carried by the trays. In this manner, the thermal responsiveness of the thermostat is also increased.

By way of further example, typical food warming trays are made in the form of shelves which fit into cabinets where the food is maintained at various desired temperatures. Every shelf element or tray has a heater and thermostat associated therewith. Typically, such shelves or warming trays may be sized on the order of 12 inches by 24 inches, 20 inches by 36 inches, and 24 inches by 36 inches, to cite a few common examples.

A presently preferred embodiment of the composite metal sheet 30 contains an aluminum layer or core 34 of Alclad aluminum having a thickness of about 0.095 inch as a starting material with a stainless steel food contacting surface 36 having a thickness of about 0.002 inch. The stainless steel mesh lower surface 38 is preferably constructed of a wire screen or mesh material wherein each wire has a thickness of about 0.010 inch in diameter with a screen mesh of about 28 wires per inch. Both the food contacting surface 36 and the wire mesh lower surface 38 are preferably constructed of type 304 stainless steel which offers good chemical/corrosion resistance. The final thickness after roll bonding of the disparate materials for the composite sheet 32 is about 0.080 inch in total thickness.

Figure 8:
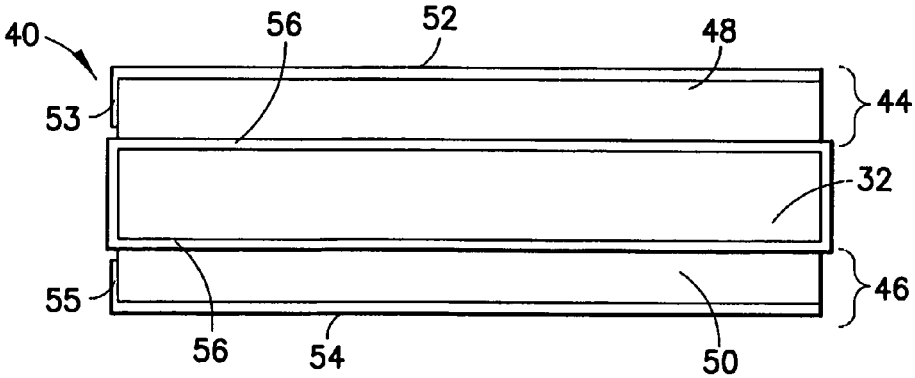

A presently preferred method for manufacturing the composite metal sheet 30 will now be explained. I prefer to first form a roll pack 40, shown in FIG. 8, to make the composite metal sheet 30. As shown in FIG. 8, the roll pack 40, after rolling, will produce two composite metal sheets 30 of FIG. 5, one from a first subassembly 44 and one from a second subassembly 46. The first subassembly 44 contains a first aluminum core layer 48 while the second subassembly 46 contains a second aluminum core layer 50. Aluminum layers 48 and 50 are the same as aluminum core layer 34 as previously discussed above with reference to FIG. 5. A stainless steel mesh sheet 52 is positioned on the top of the first aluminum layer 48 and contains an overhang portion 53 extending over the front edge of the aluminum layer 48 on the roll bite side of the roll pack 40. The first and second subassemblies 44 and 46 are separated by a heavier, reusable stainless steel plate 32 of approximately 0.125 inch in thickness, as described above. The reusable stainless steel plate 32 has a stainless steel foil envelope 56 fashioned therearound in contact at its upper surface with the lower face of the aluminum layer 48 and at its lower face with a lower plate 50 of aluminum. The lower aluminum layer 50 has a second stainless steel mesh sheet 54 positioned on its outer lower surface which contains an overhang portion 55 which also extends at the leading end of the roll pack 40 which would enter the bite of the rolling mill first. The stainless steel foil envelope 56 also continuously extends around the leading end of the reusable stainless steel plate 32 at the leading end thereof which would enter the roll bite of the rolls first. In this manner, the very thin layers of stainless steel mesh 52 and 54, as well as the stainless steel foil 56, will not be torn away from the roll pack 40 as it enters the rolling mill. The reusable stainless steel plate 32 is stationary relative to the adjacent foil layers and transfers the compressive force of the rolls to the foil and the adjacent aluminum plates without distorting the foil layers as the roll pack 40 and plate 32 move through the rolls of the rolling mill.

The roll pack 40 is assembled as shown in FIG. 8 after appropriate cleaning of the aluminum layers. The roll pack 40 is placed in the furnace and heated to a rolling temperature of about 725°-775° F., preferably about 750° F. After this temperature is reached throughout the roll pack, it is given one pass in a rolling mill with a reduction of between 10-20% being made. For example, a subassembly 44 or 46 which individually form a composite metal sheet 30 having an initial thickness of 0.095 inch, after receiving one pass in the rolling mill, would have a finished thickness of about 0.078 inch, i.e., about 18% reduction in thickness due to the one pass in the rolling mill. A very minimal elongation on the order of 1-2% in length occurs during this one-roll pass. After rolling, the subassemblies 44 and 46 separate from the reusable stainless steel plate 32 by virtue of the fact that the stainless steel foil sheet 56 becomes bonded to the adjacent aluminum layers 48 and 50 and does not bond with the stainless steel plate 32. After manufacture, the composite plate 30 can then be trimmed, polished and assembled with the appropriate thermostatic controller and electrical heating unit (not shown) as is well known in the art.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A method of making a composite metal sheet comprising the steps of:

(a) providing a roll pack of ordered layers comprising:

1. a layer of stainless steel mesh;
2. a core layer of plate of Alclad aluminum;
3. a layer of stainless steel foil;
4. a plate of stainless steel;
5. a layer of stainless steel foil;
6. a core layer of Alclad aluminum; and
7. a layer of stainless steel mesh;

(b) heating the roll pack of step (a) to a rolling temperature; and (c) rolling the heated roll pack in a rolling mill to provide two roll bonded composite sheets, the first composite sheet comprising layers (a) 1-3, and the second composite sheet comprising layers (a) 5-7 with plate (a) 4 being reusable.

* * * * *